United States Patent [19]

Lin

[11] 4,338,361

[45] Jul. 6, 1982

[54] METHOD AND APPARATUS FOR APPLYING TEXTILE SIZES

[75] Inventor: Kingso C. Lin, Newark, Ohio

[73] Assignee: Owens-Corning Fiberglas Corporation, Toledo, Ohio

[21] Appl. No.: 213,966

[22] Filed: Dec. 8, 1980

[51] Int. Cl.[3] ..... B05D 1/02

[52] U.S. Cl. ..... 427/299; 427/424; 427/444; 118/72; 118/316; 118/326; 68/5 C; 68/5 E

[58] Field of Search ..... 427/299, 424, 444; 118/72, 316, 325, 326, 65, 68; 68/5 B, 5 C, 5 D, 5 E

[56] References Cited

U.S. PATENT DOCUMENTS 3,508,947 4/1970 Hughes ..... 118/325
3,739,746 6/1973 Kodis ..... 118/326
4,285,296 8/1981 Scholes .

FOREIGN PATENT DOCUMENTS 1026581 4/1966 United Kingdom ..... 427/424

*Primary Examiner*—Shrive P. Beck
*Attorney, Agent, or Firm*—Ronald C. Hudgens; Philip R. Cloutier; Ted C. Gillespie

[57] ABSTRACT

A method and apparatus for applying size to an array of fibers of the type in which the array of fibers is directed past at least one nozzle adapted to spray a size onto the array of fibers, wherein the improvement comprises means, positioned immediately upstream from the nozzle, for removing the entrained gases flowing with the array of fibers and a conduit having a decreasing cross sectional area in the downstream direction positioned downstream from the nozzle.

7 Claims, 3 Drawing Figures

METHOD AND APPARATUS FOR APPLYING TEXTILE SIZES

TECHNICAL FIELD

This invention relates to applying textile sizes to textile fibers. More particularly, this invention relates to spraying size material onto an array of fibers. In one of its more specific aspects, this invention relates to applying sizes to downwardly moving arrays of mineral fibers, such as glass fibers.

In a present fiber collection operation, the fibers in an array are passed into contact with an applicator surface which applies a size material to the array of fibers. In general, it has been found necessary to have actual contact between the fibers and the applicator surface in order to transfer sufficient amounts of the size material onto the fibers. It has been found to be desirable for the size to be applied while the fibers in the array are still separated from each other, rather than after the fibers have been gathered into a strand or bundle. Separation of the fibers during size application helps insure uniformity of the size coating and prevents fiber abrasion.

One of the problems associated with existing textile size application processes is that the contact between the fibers and the applicator surface adversely affects the fiber forming and size application processes. The contact between the fibers and the applicator surface causes a drag force which affects the tension in the fibers, thereby adversely affecting the uniformity of tension among the fibers in the array. Nonuniformity in tension among the fibers in the array results in a nonuniformity of fiber diameter in the array, since the fiber diameter is a function of tension. Moreover, the added tension in the fiber forming process supplied by the contact with the applicator surface causes a relatively high percentage of fiber breaks. The problems of fiber breaks due to contact with the applicator surface are exacerbated by the high speeds at which the fibers in the array travel in modern fiber forming processes. Typically, the fibers travel past the size applicator at speeds of 1500 meters/minute or more.

Attempts to solve the size application problem by using a non-contact-type applicator have not been successful. The use of spray nozzles to apply the size to the fibers without contacting the fibers with an applicator surface has been found to be unsuccessful due to lack of uniformity of the size application. The fast moving array of fibers develops an associated flow of entrained air and it is difficult for airborne size particles to penetrate the entrained air to effectively coat the fibers within the interior of the array. Small size particles atomized in a spray size process have insufficient mass to penetrate the entrained air and reach the interior of the array of fibers.

SUMMARY OF THE INVENTION

There has now been discovered a size applicator and method having improved ability to coat with a size material all of the fibers in the array in the absence of contact with an applicator surface. According to this invention, there is provided apparatus for applying size to an array of fibers of the type in which the array of fibers is directed past at least one nozzle adapted to spray a size onto the array of fibers, where the improvement comprises a stripper positioned immediately upstream from the nozzle for removing the entrained gases flowing with the array of fibers, where the stripper comprises a pair of intersecting plates, each plate being mounted to lie in a plane at an acute angle to the direction of movement of the array of fibers, and where an opening is positioned in the stripper along the intersection of the plates for the passage of the array of fibers therethrough. The removal of the entrained gases at a position immediately upstream from the nozzle enables the atomized size particles from the nozzle to penetrate the array and more effectively coat the fibers in the array.

In a preferred embodiment of the invention, the array of fibers is drawn through an orificed bushing plate and the opening in the stripper has an area within the range of from about 10 percent to about 40 percent of the area of the orificed bushing plate.

In a more preferred embodiment of the invention, the opening of the stripper has an area within the range of from about 15 percent to about 30 percent of the area of the orificed plate.

In the most preferred embodiment of the invention, the opening in the stripper is about 24 percent of the area of the orificed plate.

According to this invention, there is also provided apparatus for applying size to a converging array of fibers of the type in which the array of fibers is directed past at least one nozzle adapted to spray a size onto the array of fibers, where the improvement comprises a stripper positioned immediately upstream from the nozzle for removing the entrained gases flowing with the array of fibers, and a conduit positioned downstream from the nozzle and through which the array of fibers passes, where the conduit has a decreasing cross sectional area in the downstream direction. The conduit provides a confined passageway in which the likelihood of impingement of atomized size particles onto the fibers in the fast moving array is increased.

In a specific embodiment of the invention, the walls of the conduit converge to follow the convergence of the array of fibers within the conduit.

In another embodiment of the invention, the downstream end of the walls of the conduit are adapted with size recovery members. Means can be provided for recycling size from the size recovery members.

In the most preferred embodiment of the invention, the stripper is hinged for opening to insert the array of fibers therein.

According to this invention, there is also provided a method for applying a size to an array of fibers of the type in which the array of fibers is directed past at least one nozzle adapted to spray a size onto the array of fibers, where the improvement comprises removing the entrained gases flowing with the array of fibers by passing the array of fibers through an opening in a stripper positioned immediately upstream from the nozzle.

According to this invention, there is also provided a method for applying a size to a converging array of fibers of the type in which the array of fibers is directed past at least one nozzle adapted to spray a size onto the array of fibers, where the improvement comprises removing the entrained gases flowing with the array of fibers from a position immediately upstream from the nozzle, and passing the array of fibers through a narrow, converging conduit positioned downstream from the nozzle.

In a specific embodiment of the invention, a portion of the size is recovered at the downstream end of the conduit. The recovered size can be recycled.

DESCRIPTION OF THE INVENTION

The following description of the preferred embodiment in terms of a glass fiber forming and collecting operation is offered for purposes of illustration of the principles of this invention, and it is not intended to be limiting.

Figure 1:
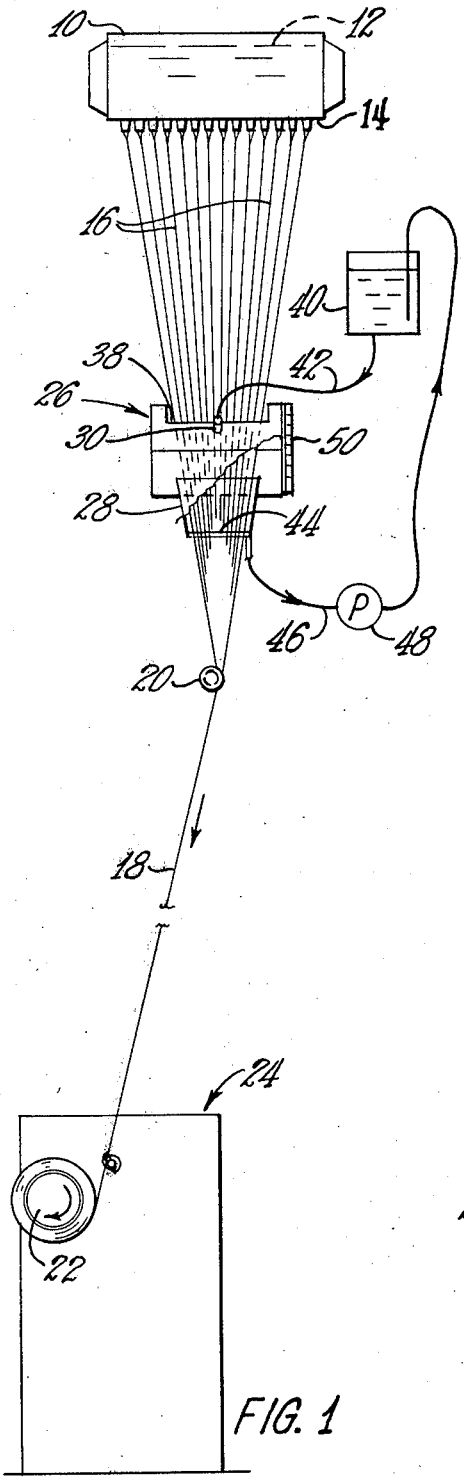
FIG. 1 is a schematic view in elevation of a glass fiber forming and collection apparatus according to the principles of the invention.
Figure 2:
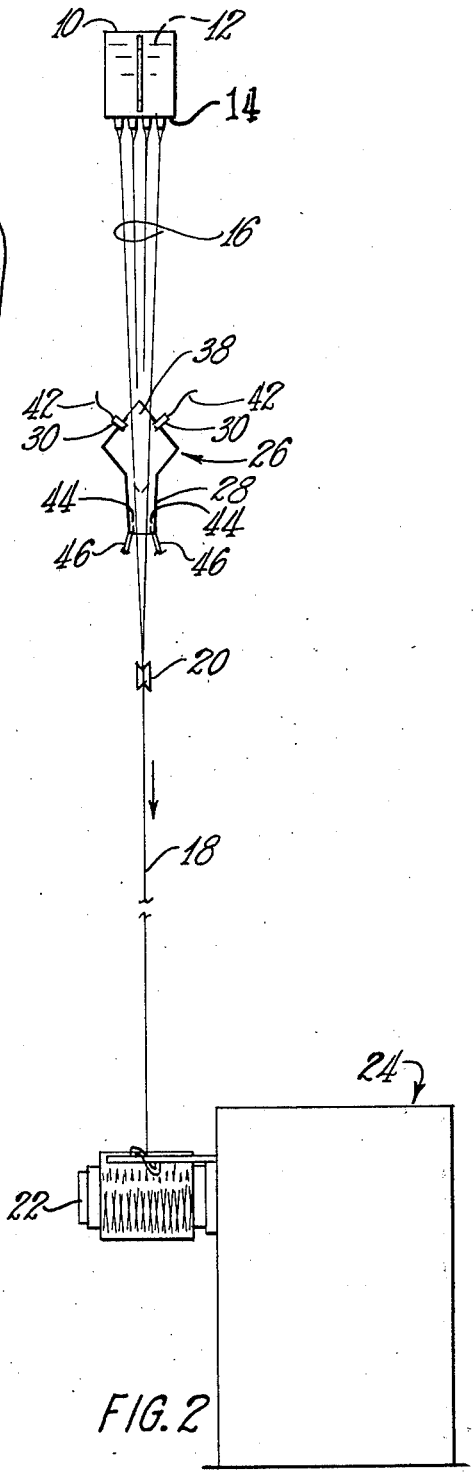
FIG. 2 is a schematic end view of the apparatus shown in FIG. 1.

In FIGS. 1 and 2, there is shown glass melter 10 containing supply of molten glass 12. The melter bottom wall is comprised of orificed bushing plate 14 through which streams of glass emerge to form downwardly traveling array of fibers 16. The array of fibers is gathered into strand 18 by gathering shoe 20 and wound onto rotating collet 22 which can be rotated by winder 24.

Prior to being gathered into a strand, the array of fibers is passed through the apparatus for applying the sizing material. The apparatus is comprised of means for removing entrained air, such as stripper 26, a conduit such as dwell conduit 28, and one or more nozzles 30.

Figure 3:
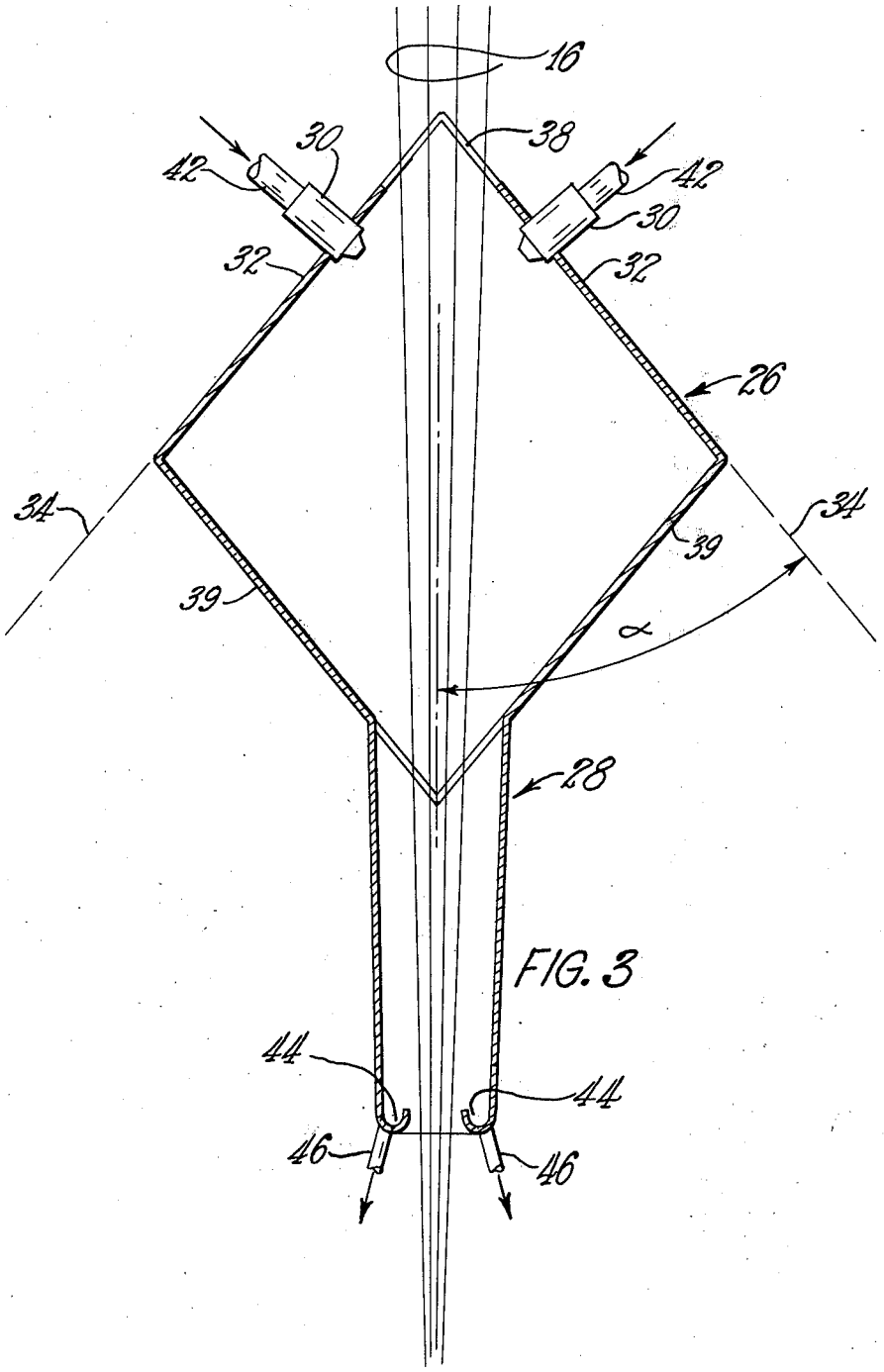
FIG. 3 is a schematic view in elevation of the size applicator of the invention.

The stripper can be of any design suitable for removing the entrained air from the array of fibers immediately upstream from the nozzle. Preferably, the stripper is comprised of a pair of intersecting plates 32, where each plate is mounted to lie in a plane at an acute angle alpha to the direction of movement of the array of fibers, such as planes 34 shown in FIG. 3. At the intersection of the plates, a narrow opening, such as opening 38, is provided so that the array of fibers can be pulled through the stripper. It has been found that the opening should have an area within the range from about 10 percent to about 40 percent of the area of the orificed bushing plate. Preferably, the opening has an area within the range of from about 15 percent to about 30 percent of the area of the orificed bushing plate. In the most preferred embodiment of the invention, the area of the opening is about 24 percent of the area of the orificed bushing plate. Two additional plates 39 can be mounted in contact with plates 36 to define a chamber in which the size material is sprayed onto the array of fibers.

The nozzles can be of any type suitable for providing airborne size particles. The nozzles are supplied with a size material from size material source 40 via size supply conduit 42, as shown schematically in FIG. 1.

The dwell conduit, which is positioned downstream from the nozzles and through which the array of fibers passes, has a decreasing cross sectional area in the downstream direction. The walls of the dwell conduit converge in the downward or downstream direction to follow the convergence of the array of fibers within the dwell conduit. The converging walls of the dwell conduit maintain the smallest possible cross sectional area of the dwell conduit without causing contact between the dwell conduit and the fibers in the array. The narrowness and converging character of the dwell conduit insure that the tiny atomized size particles will be in close proximity to the fibers in the array, thereby facilitating impingement of the size on the fibers. The narrowness of the dwell conduit also causes considerable turbulence among the gases and size particles within the dwell conduit, resulting in increased size application efficiency. The effectiveness of the dwell conduit is a function of its length, and the longer the conduit, the greater the opportunity for size particles to impinge on the fibers.

Positioned at the downstream end of the dwell conduit are means, such as size recovery troughs 44, for recovering size material which has impinged upon the walls of the dwell conduit. The recovered size material can be drawn via size recycling tubes 46 by means of size recycling pump 48 and henceforth reintroduced into the size application system. The amount of size recovered in the size recovery troughs is a function of the length of the dwell conduit since more airborne size particles are able to impinge upon the walls of conduits of longer length.

The air stripper can be adapted with hinge 50 to enable the entire apparatus including the dwell conduit to be opened for the insertion of the array of fibers.

INDUSTRIAL APPLICABILITY

This invention will be found to be useful in the formation of fibers from molten glass for such uses as glass fiber reinforcements and glass fiber textile products.

I claim:

1. Apparatus for applying size to an array of fibers of the type in which the array of fibers is drawn through an orificed bushing plate and is directed past at least one nozzle adapted to spray a size onto the array of fibers, wherein the improvement comprises a stripper for removing the entrained gases flowing with the array of fibers, said stripper having a pair of intersecting plates, each plate being mounted to lie in a plane at an acute angle to the direction of movement of the array of fibers, and an opening in said stripper positioned along the intersection of said plates for the passage of the array of fibers therethrough, said opening having an area within the range of from about 10 percent to about 40 percent of the area of said orificed bushing plate.

2. The apparatus of claim 1 in which said opening has an area within the range of from about 15 percent to about 30 percent of the area of said orificed plate.

3. The apparatus of claim 2 in which said opening has an area of about 24 percent of the area of said orificed bushing plate.

4. The method for applying a size to an array of fibers of the type in which the array of fibers is drawn through an orificed bushing plate and is directed past at least one nozzle adapted to spray a size onto the array of fibers, wherein the improvement comprises removing the entrained gases flowing with the array of fibers by passing the array of fibers through an opening in a stripper positioned immediately upstream from said nozzle, the area of said opening being within the range of from about 10 percent to about 40 percent of the area of said orificed bushing plate.

5. The method of claim 4 in which said opening has an area within the range of from about 15 percent to about 30 percent of the area of said orificed bushing plate.

6. The method of claim 5 in which said opening has an area of about 24 percent of the area of said orificed bushing plate.

7. The method for applying a size to a converging array of mineral fibers of the type in which the array of mineral fibers is directed between a pair of nozzles adapted to spray a size onto the array of mineral fibers, wherein the improvement comprises removing the entrained gases flowing with the array of fibers by passing the array of fibers through an opening in a stripper positioned immediately upstream from said nozzles, passing the array of fibers through a narrow, converging conduit positioned downstream from said nozzles, and recovering a portion of said size at the downstream end of said conduit.

* * * * *